US009364740B2

(12) United States Patent
Gibson, Jr.

(10) Patent No.: US 9,364,740 B2
(45) Date of Patent: Jun. 14, 2016

(54) TABLE AND GAME FOR MARBLES

(71) Applicant: David L. Gibson, Jr., Ashland City, TN (US)

(72) Inventor: David L. Gibson, Jr., Ashland City, TN (US)

( * ) Notice: Subject to any disclaimer, the term of this patent is extended or adjusted under 35 U.S.C. 154(b) by 10 days.

(21) Appl. No.: 14/293,798

(22) Filed: Jun. 2, 2014

(65) Prior Publication Data

US 2014/0353911 A1 Dec. 4, 2014

Related U.S. Application Data

(60) Provisional application No. 61/829,403, filed on May 31, 2013, provisional application No. 62/001,095, filed on May 21, 2014.

(51) Int. Cl.

| | |
|---|---|
| ***A63F 7/34*** | (2006.01) |
| ***A63F 7/00*** | (2006.01) |
| *A63F 7/36* | (2006.01) |

(52) U.S. Cl.

CPC ..... *A63F 7/0023* (2013.01); *A63F 2007/341* (2013.01); *A63F 2007/3674* (2013.01)

(58) Field of Classification Search

CPC ..... A63F 7/00; A63F 7/0023; A63F 7/0005; A63F 7/34; A63F 2007/341; A63F 2007/345; A63F 2007/346; A63F 7/36; A63F 7/3622; A63F 7/3674

USPC ..... 273/118 R, 119 R, 121 R, 122 R, 123 R, 273/124 R, 125 R

See application file for complete search history.

(56) References Cited

U.S. PATENT DOCUMENTS

| | | | | |
|---|---|---|---|---|
| 1,517,726 A | | 12/1924 | Grady | |
| 2,636,740 A | * | 4/1953 | McNeal | A63F 7/0023 273/118 R |
| 2,639,151 A | * | 5/1953 | Kennon | A63F 7/0023 273/118 R |
| 2,815,213 A | * | 12/1957 | Wisener | A63F 7/00 273/118 R |
| 3,526,404 A | * | 9/1970 | Wiggins | A63F 7/0023 273/118 R |
| 4,445,689 A | * | 5/1984 | Rainey | A63C 19/04 273/118 R |
| 4,445,690 A | * | 5/1984 | Cairns | A63F 7/0023 273/118 R |

(Continued)

FOREIGN PATENT DOCUMENTS

GB 364468 A 1/1932

OTHER PUBLICATIONS

International Preliminary Report on Patentability and Written Opinion of the International Searching Authority, PCT/US2014/40548 (Gibson.

*Primary Examiner* — Raleigh W Chiu

(74) *Attorney, Agent, or Firm* — W. Edward Ramage; Baker Donelson

(57) ABSTRACT

An apparatus for playing marbles games. The apparatus is a circular or polygonal playing board or ring, which encompasses a playing surface. A top ring extends above the playing board along its outer circumference, and may extend over the outer perimeter of the playing board, allowing marbles struck off the playing surface to pass underneath into a marble collection mechanism. Marbles drop onto a sloped guide track, and then roll down to one of a plurality of collections slots.

9 Claims, 18 Drawing Sheets

(56) References Cited

U.S. PATENT DOCUMENTS 4,549,737 A * 10/1985 Seyer ..... A63D 15/00 273/118 R
4,699,381 A * 10/1987 Vaughn ..... A63F 7/0023 273/118 R
4,998,729 A * 3/1991 Lischerelli ..... A63F 7/0023 273/118 R
5,139,259 A * 8/1992 Yeakley ..... A63F 7/0023 273/118 A
5,314,367 A 5/1994 Schaefer
5,549,295 A * 8/1996 Goldring ..... A63F 7/0023 273/109
6,485,018 B2 * 11/2002 Lorenz ..... A63F 7/386 273/110
6,688,596 B2 * 2/2004 Nielsen ..... A63F 7/06 273/118 R
2003/0042671 A1 * 3/2003 Houston, Jr. ..... A47B 13/081 273/118 R
2003/0155707 A1 * 8/2003 Nielsen ..... A63F 7/06 273/118 R
2014/0353911 A1 * 12/2014 Gibson, Jr. ..... A63F 7/0023 273/118 R

* cited by examiner

TABLE AND GAME FOR MARBLES

This application claims benefit of and priority to U.S. Provisional Application No. 61/829,403, filed May 31, 2013, and 62/001,095, filed May 21, 2014, by David Gibson, and is entitled to those filing dates for priority. The specifications, figures and complete disclosures of U.S. Provisional Application No. 61/829,403 and 62/001,095 are incorporated herein by specific reference for all purposes.

FIELD OF INVENTION

This invention relates to a table for playing marble games. More specifically, this invention relates to a table for playing marbles games with an improved marble return mechanism.

BACKGROUND OF INVENTION

The use of tables for marble games is known in the prior art. An example is the table disclosed in Vaughn, U.S. Pat. No. 4,699,381, which is incorporated herein by specific reference in its entirety for all purposes. Other devices for playing marble games are disclosed in U.S. Pat. Nos. 3,526,404; 4,445,690; and 4,445,689, all of which are incorporated herein by specific reference in their entireties for all purposes. However, the prior art has several problems and limitations with regard to effective marble collection and return.

SUMMARY OF INVENTION

In various embodiments, the present invention comprises a table for playing marbles. The table comprises a base which provides support for the playing table above a surface. The base may be of a variety of configurations, and may comprise a single central pillar, or three or four legs or supports. The base can rest on a table, counter, or other surface, or the apparatus stand alone as its own separate table.

The top of the playing table comprises a playing board with an upper playing surface. In the embodiment shown, the playing board is circular, with an outer circumferential edge (although other geometric shapes for boards may be used). A top ring extends above the playing board along its outer circumference, and has an inner diameter less than the diameter of the playing board. In one embodiment, the top ring is padded so that users may rest their hands or arms thereon.

The top ring is suspended a certain distance off the upper playing surface, so that marbles that are struck off the playing surface pass under the top ring, and in doing so, drop onto a marble guide track. The marble guide tracks are sloped so as to cause the marble to roll down to one of a plurality of collection slots, which are located on the outside of the table. In one embodiment, there are four collection slots, although any other number may be used.

The marble drops through the collection slot to a marble channel board with a channel sloping down towards the outside of the table. The marble rolls down the marble channel until it reaches a hole in the end of the channel which has a vertical backing, whereupon it drops into a receiving box or holder. The holder comprises a T-shaped set of channels with the top of the T-shape on the outside of the table. The marble proceeds to the end of one of the channels at the top of the T-shape and comes to a rest. This mechanism prevents marbles from getting stuck inside or failing to exit the collection mechanism, and the position on the outside of the table allows marbles to be quickly and easily retrieved without being lost.

DETAILED DESCRIPTION OF EXEMPLARY EMBODIMENTS

Figure 1:
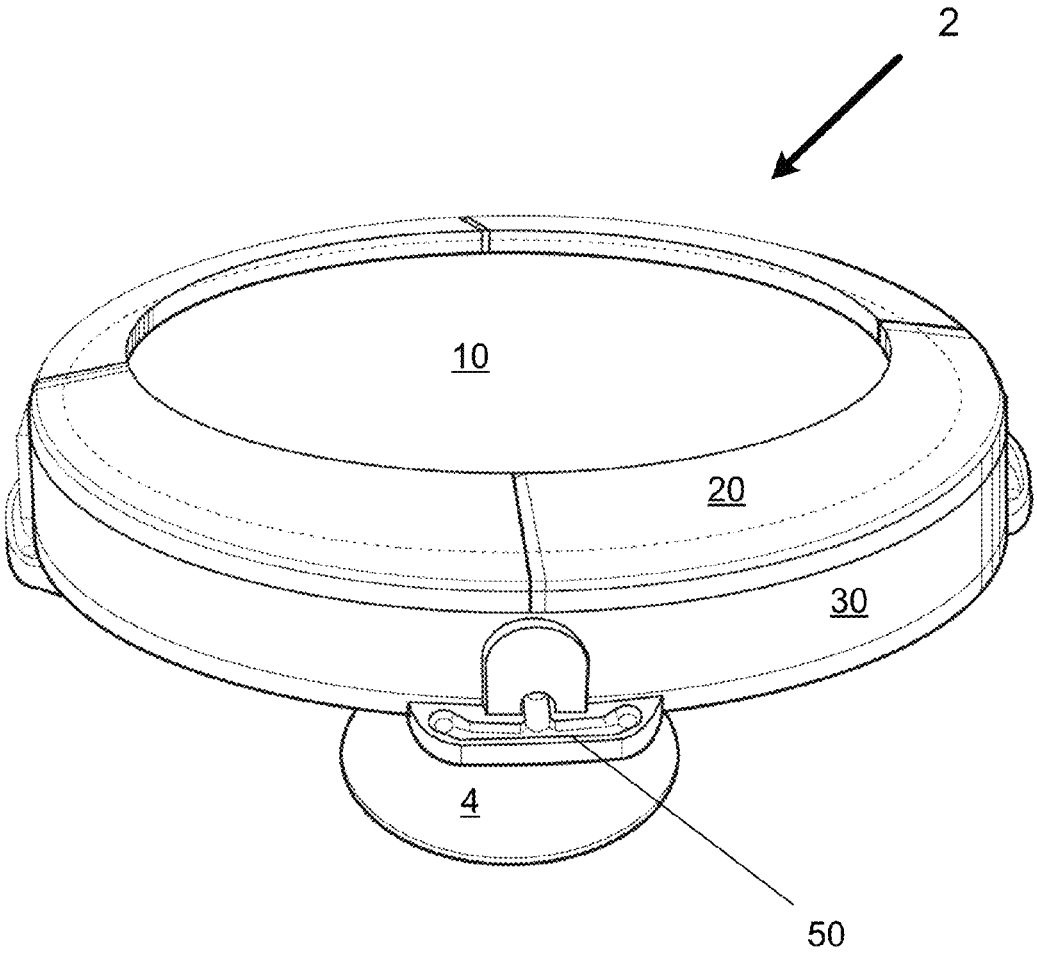
FIG. 1 shows a perspective view of a playing table in accordance with an embodiment of the present invention.

In various embodiments, as seen in FIGS. 1-12, the present invention comprises an apparatus or table 2 for playing marbles. The apparatus or table comprises a base 4 which provides support for the playing table above a surface. The base may be of a variety of configurations, and may comprise a simple flat base or support (or multiple flat supports around the perimeter), a single central pillar, or three or four legs or supports, as seen in FIG. 1. The base can rest on a table, counter, or other surface, or the apparatus stand alone as its own separate table. In one embodiment, the playing table is approximately table height above the floor so players may stand while playing. The base may include levers to allow the playing surface to be adjusted to be horizontal or flat.

The top of the playing table comprises a playing board 10 with an upper playing surface 12. In the embodiment shown, the playing board is circular, with an outer circumferential edge (although other polygonal or geometric shapes for boards may be used). A top ring 20 with an upper surface and a lower surface extends above the playing board along its outer circumference. In one exemplary embodiment, the ring has an inner diameter less than the diameter of the playing board. The top ring 20 may be padded (such as with foam padding 20*a*, which may be covered, affixed to a ring base 20*b*) on its upper surface and outer edge so that users may rest their hands or arms thereon. One or more sidewalls 30 extend from the top ring to the base.

The top ring 20 is suspended a certain distance off the upper playing surface, so that marbles that are struck off the playing surface pass through the gap between the bottom of the top ring and the upper playing surface, and in doing so, drop onto a marble guide track 40, which may be inside or outside the table. The size of the gap may be set so as to allow only certain marbles (i.e., of smaller diameter) to pass, and to keep other marbles (with a larger diameter) on the table. An angled strip 22 is affixed to the corner where the top ring joins the sidewall, and is positioned above the marble guide tracks. The angled edge of the angled strip helps deflect the marbles downward onto the guide tracks, and prevents marbles from bouncing back out onto the playing surface.

The marble guide tracks 40 are sloped so as to cause the marble 4 to roll down to one of a plurality of collection slot mechanisms 50, which are located on the outside of the table.

Figure 2:
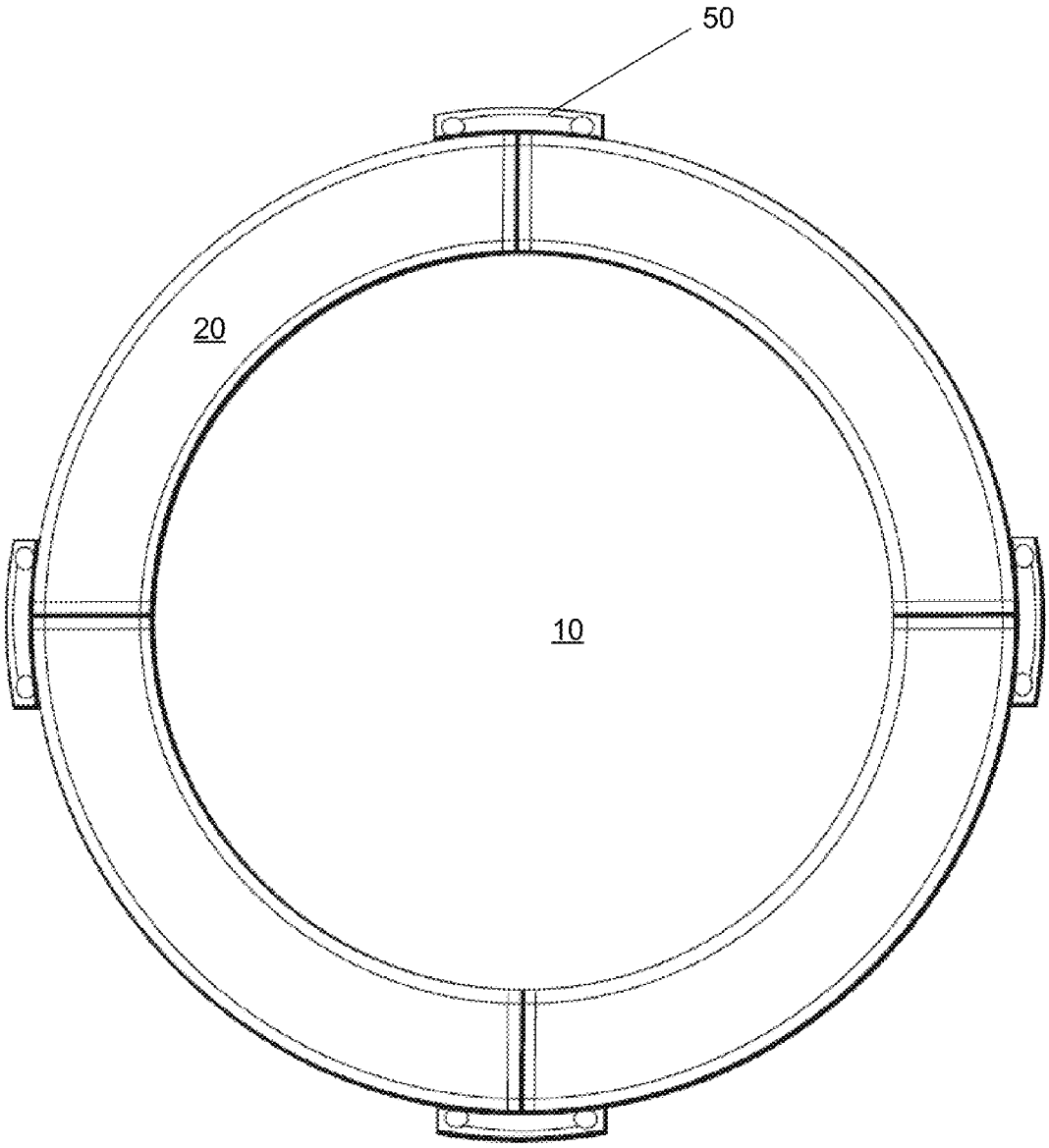
FIG. 2 shows a top view of the playing table of FIG. 1.
Figure 3:
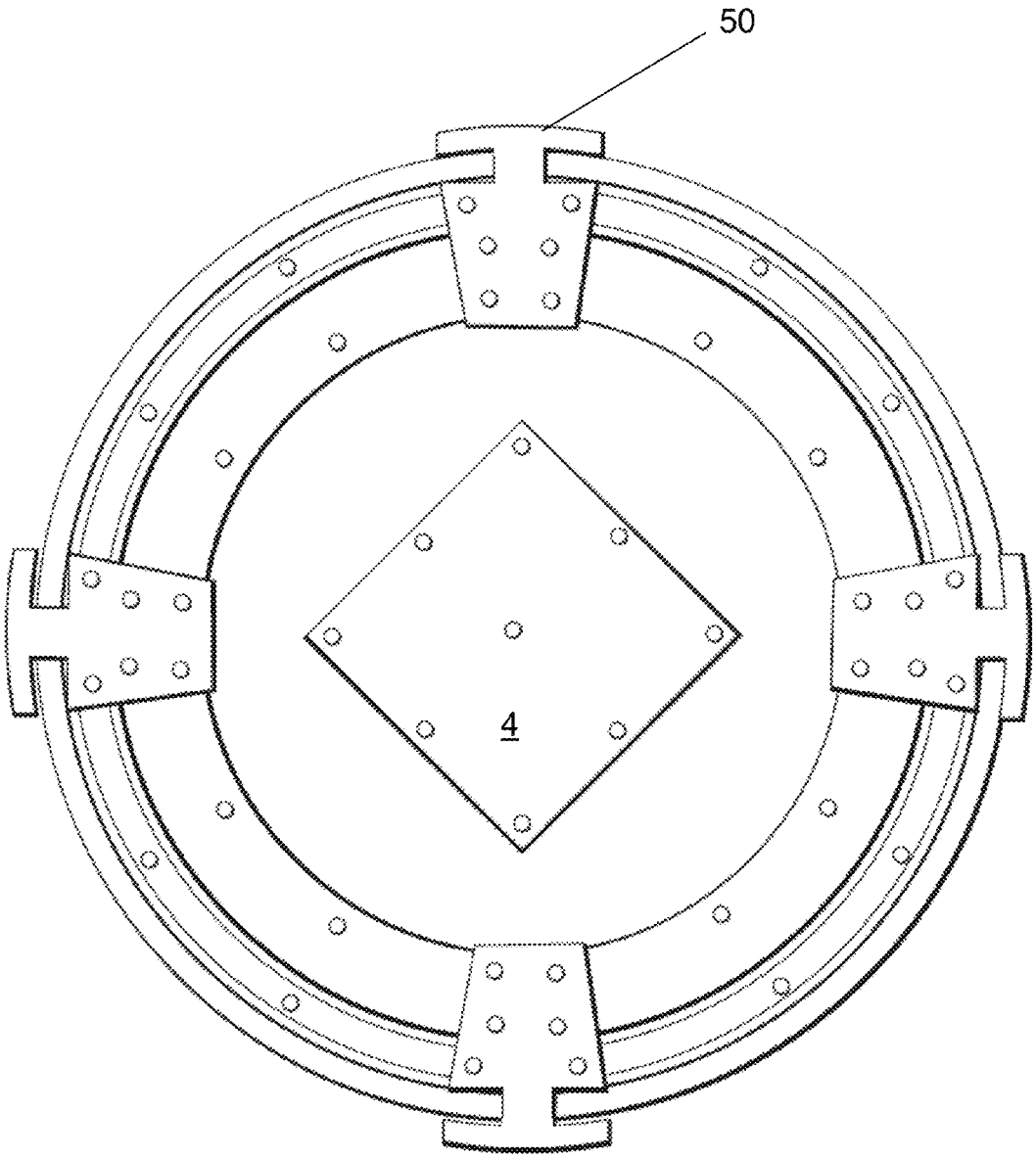
FIG. 3 shows a bottom view of the playing table of FIG. 1.
Figure 4:
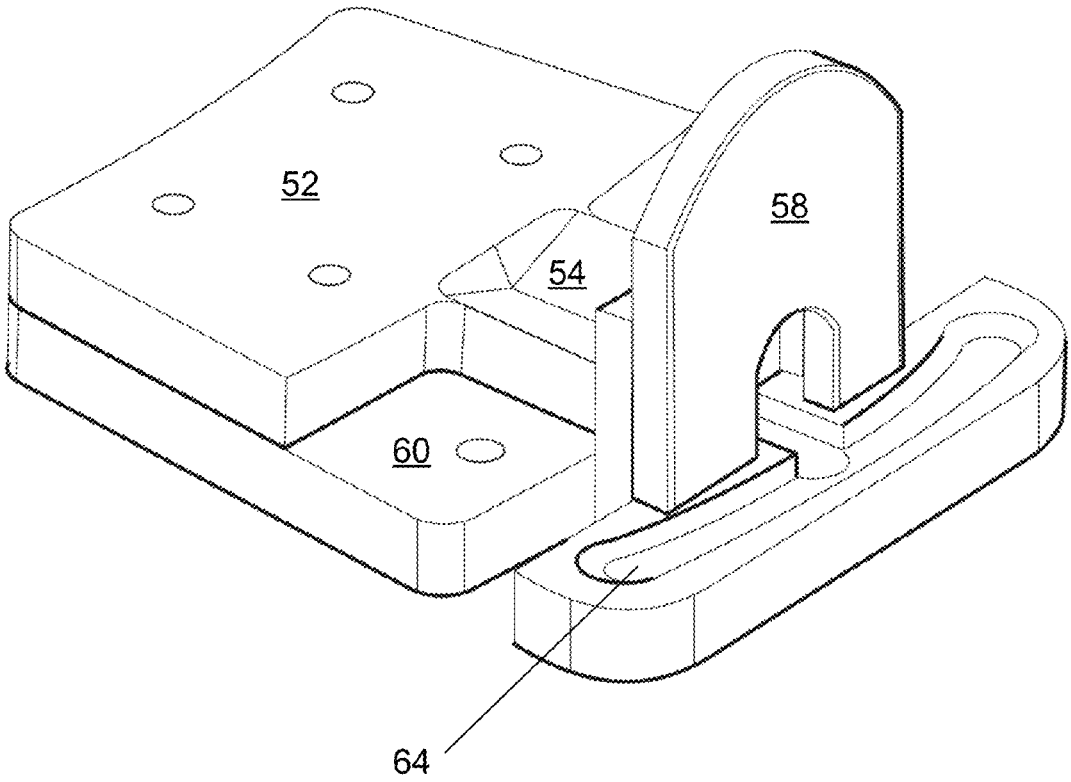
FIG. 4 shows a view of the marble collection slot mechanism.
Figure 5:
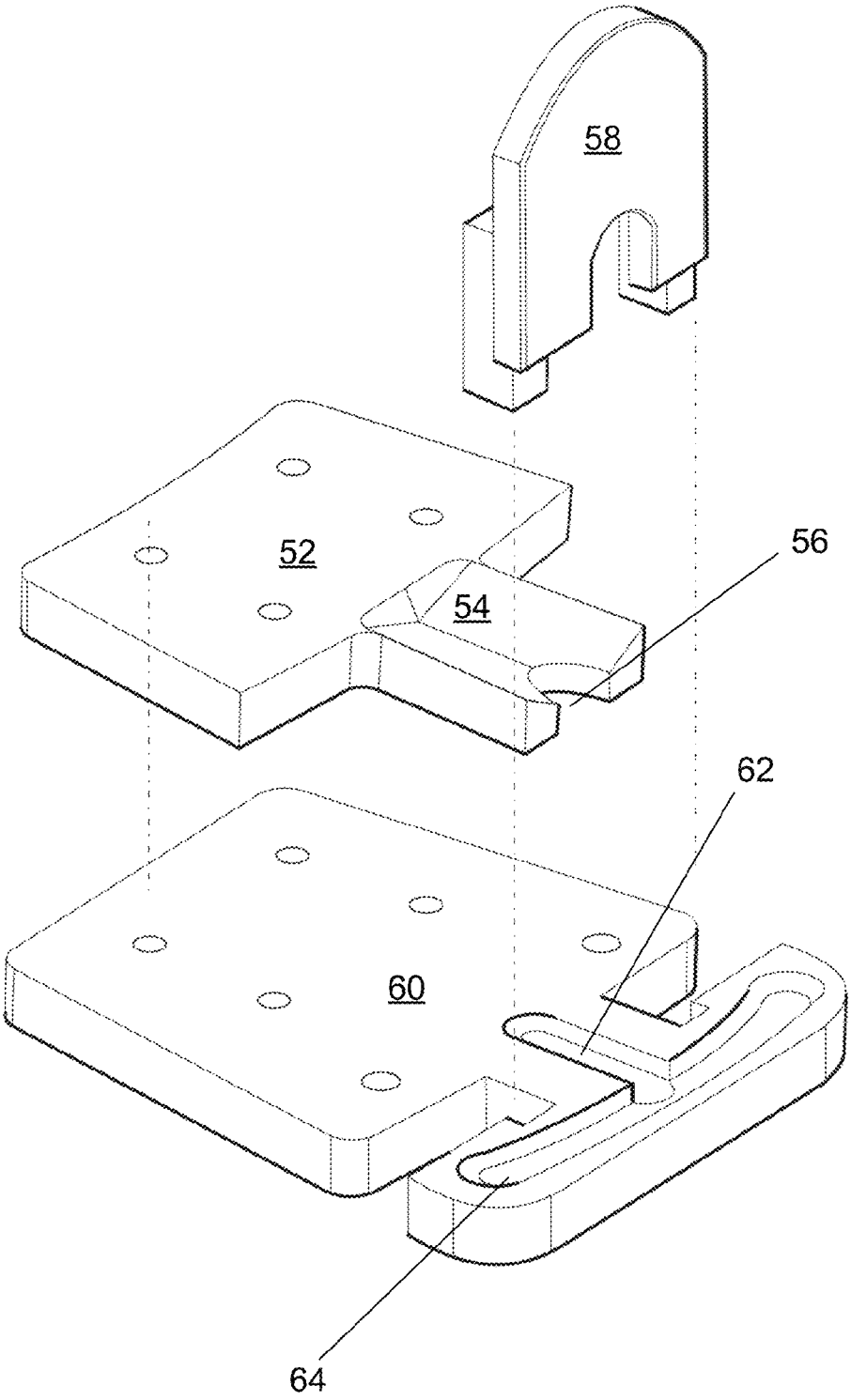
FIG. 5 shows an exploded view of the marble collection slot mechanism.
Figure 6:
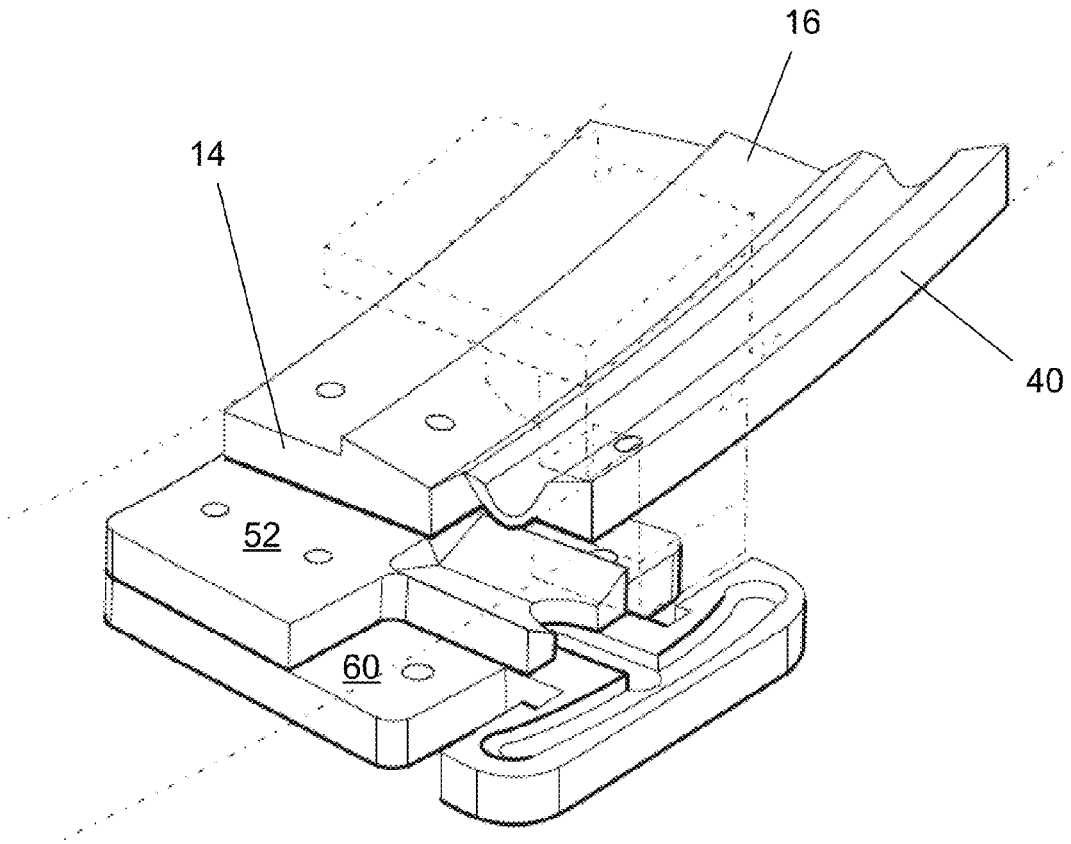
FIGS. 6-12 show views of the marble collection slot mechanism with guide track.
Figure 7:
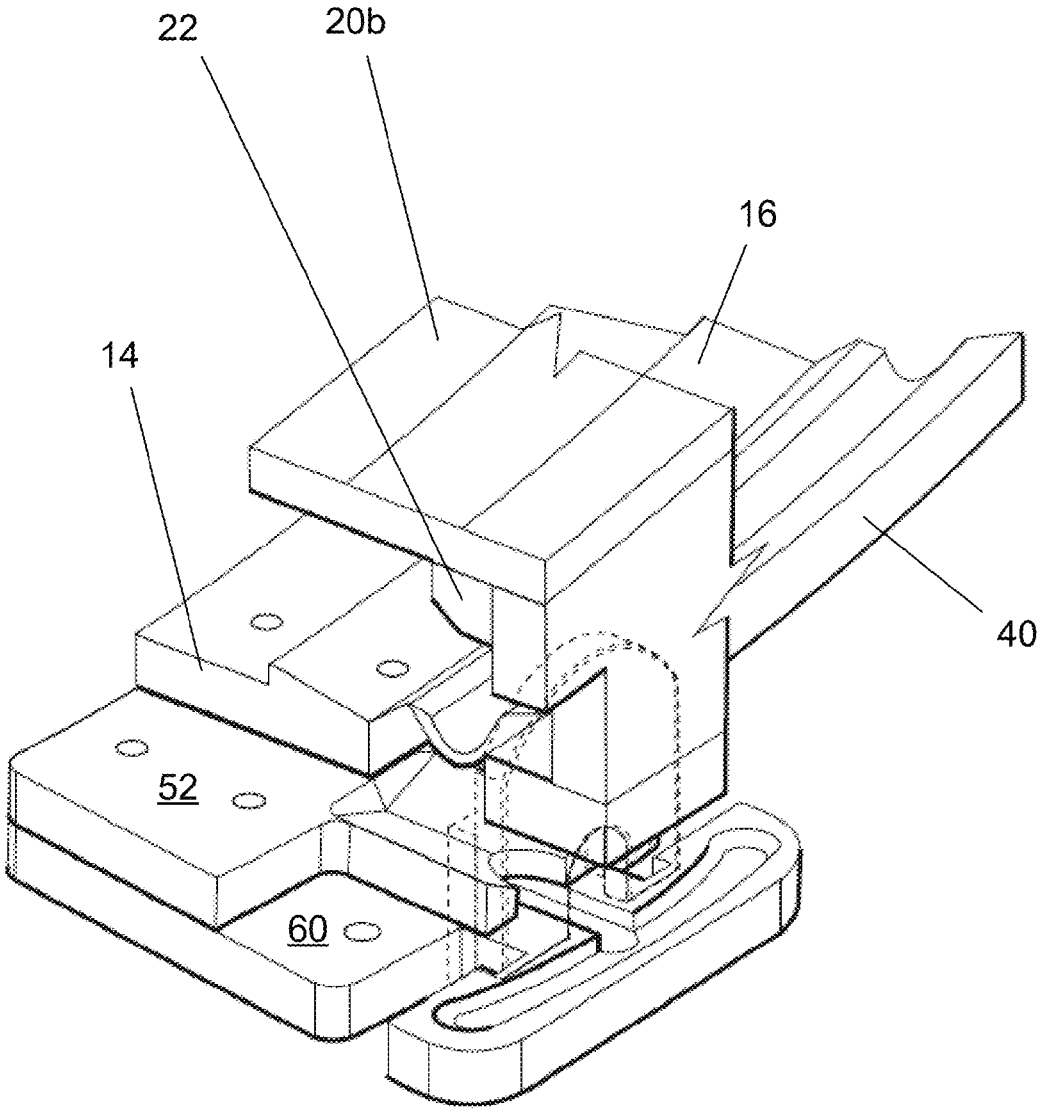
Figure 8:
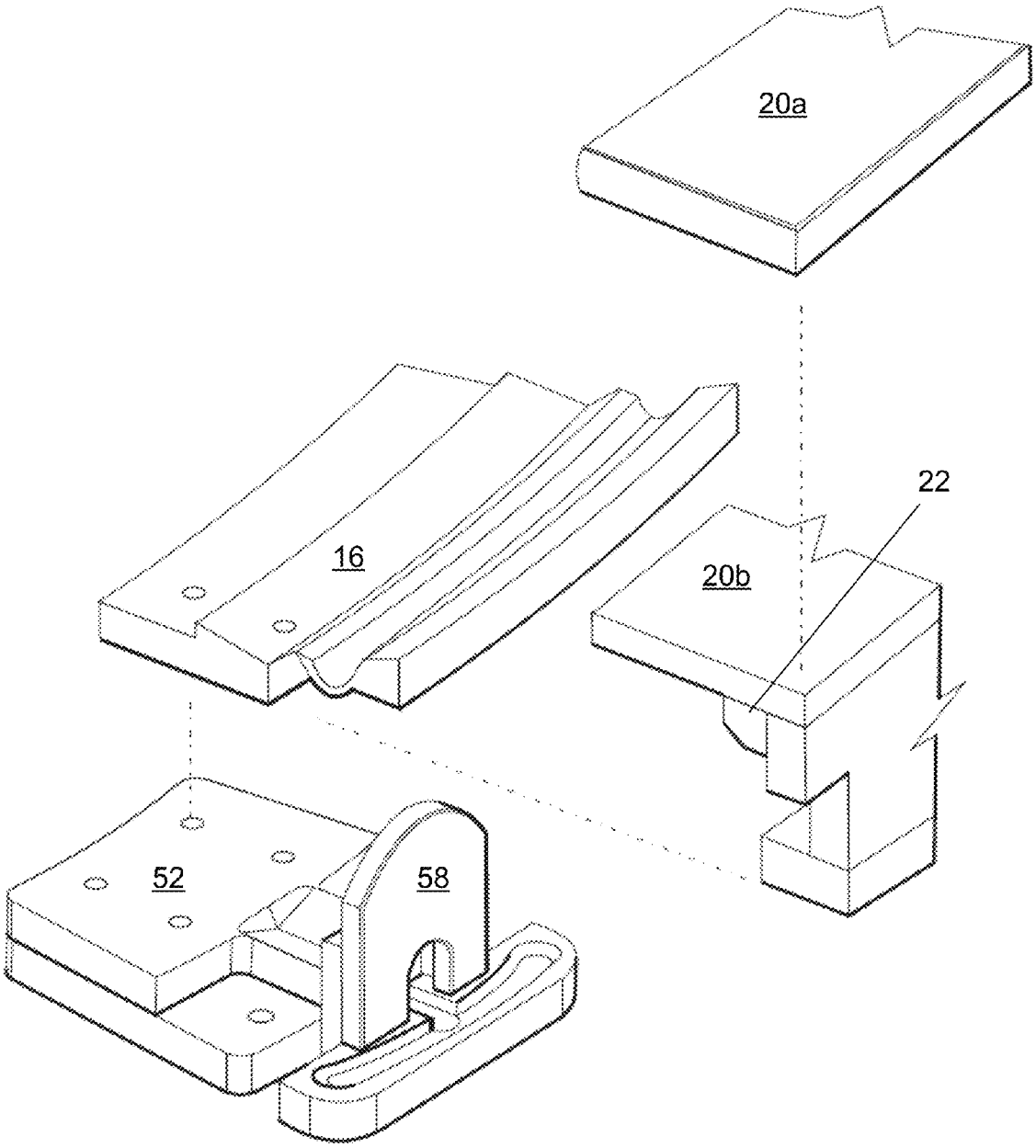

In the embodiment shown in FIGS. 1-3, there are four collection slot mechanisms, although any other number may be used.

Figure 9:
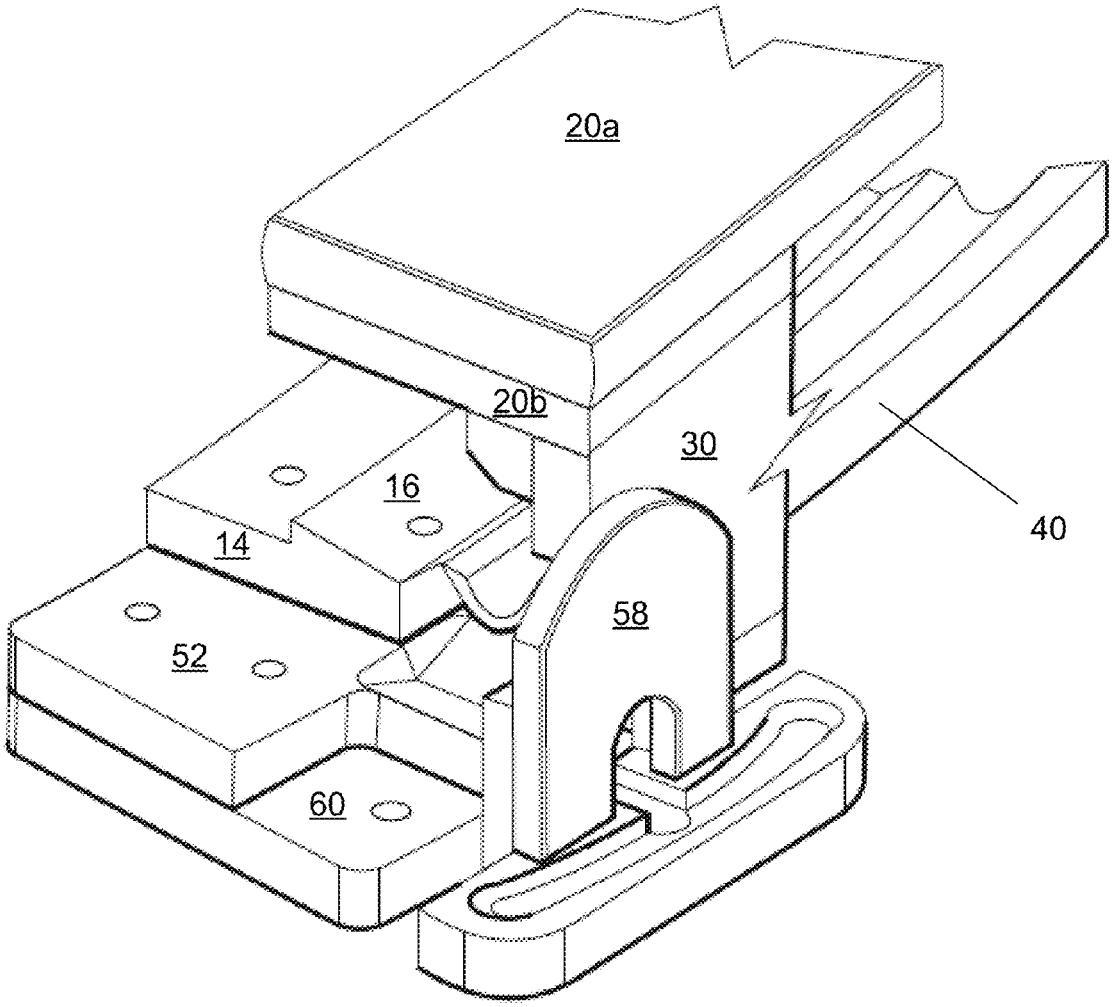
Figure 10:
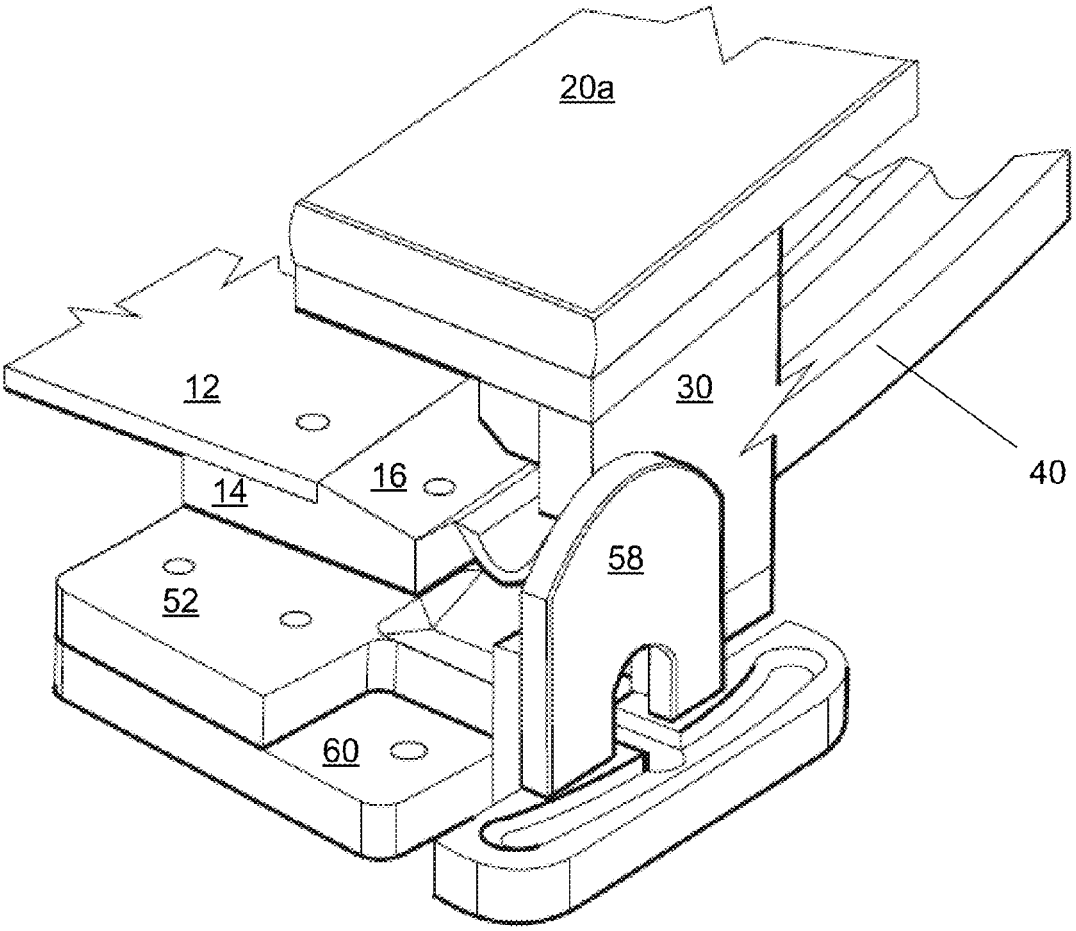
Figure 11:
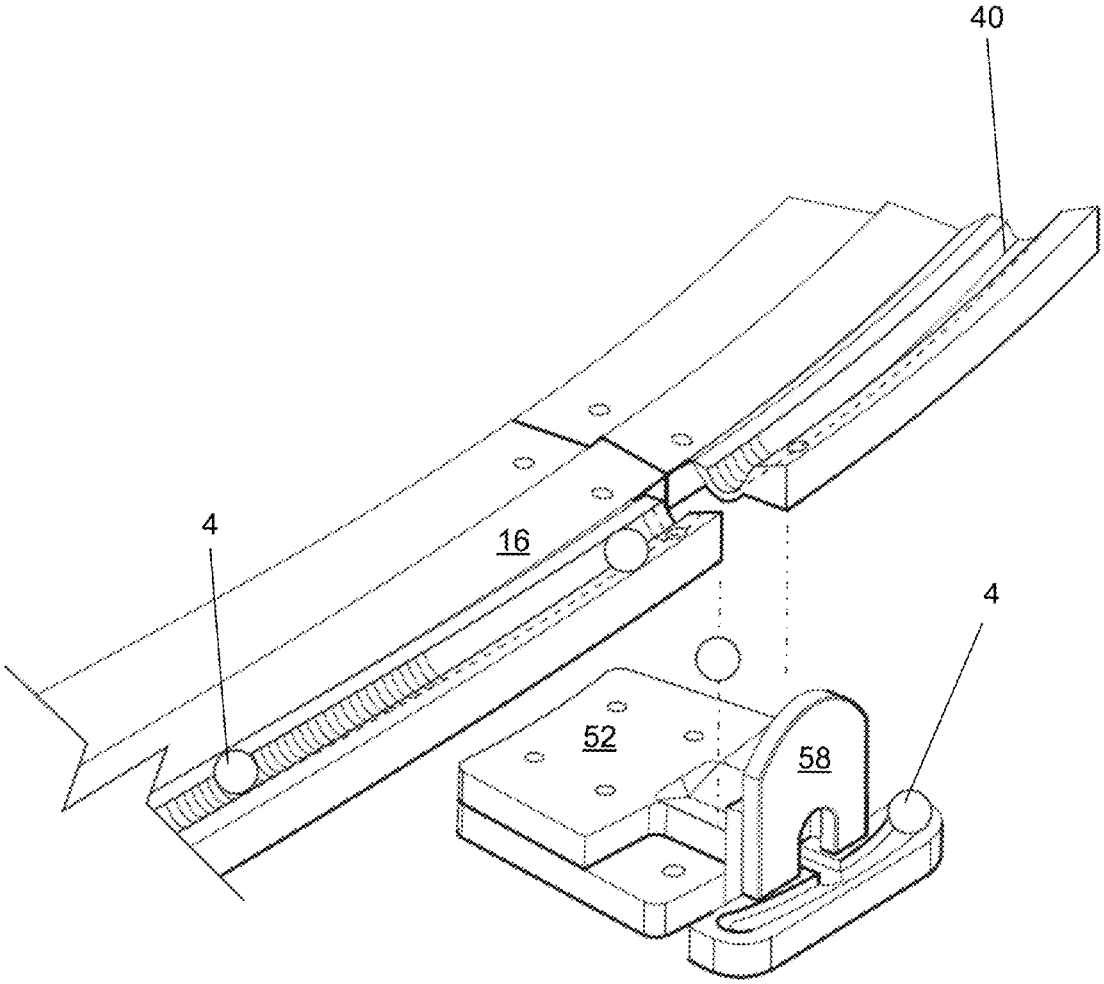
Figure 12:
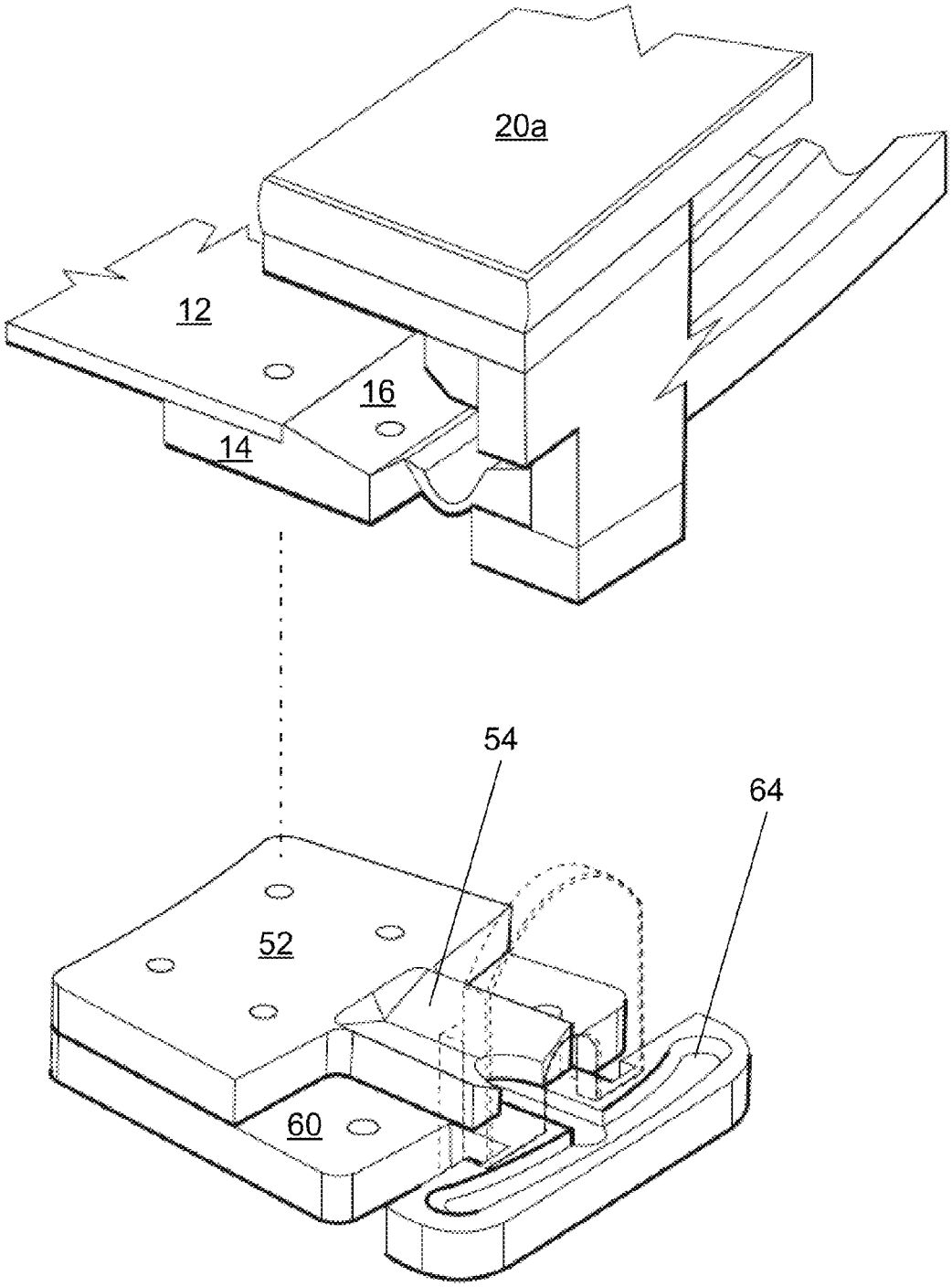
Figure 13:
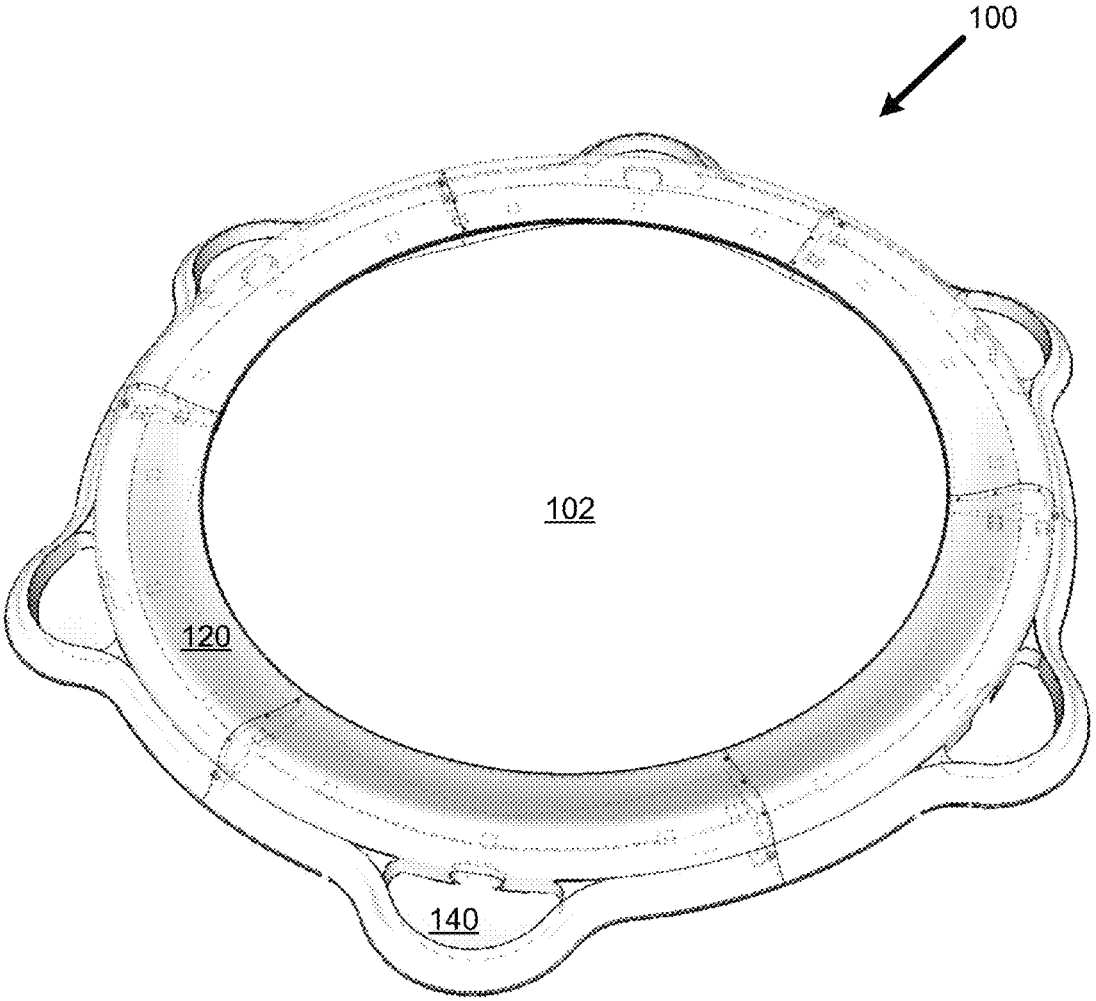
FIG. 13 shows a perspective view of a playing ring in accordance with another embodiment of the present invention.
Figure 14:
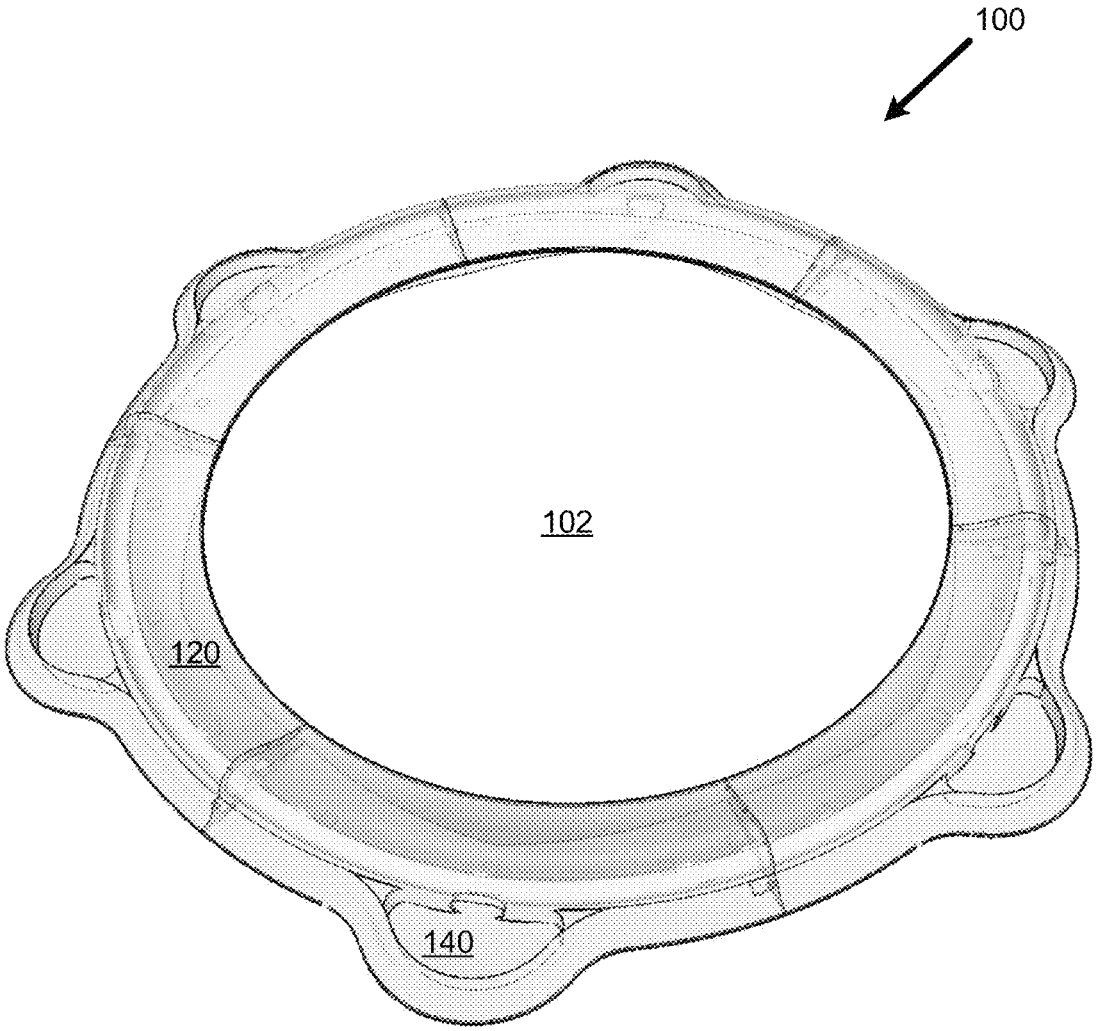
FIGS. 14-15 show additional perspective views of the playing ring of FIG. 13.
Figure 15:
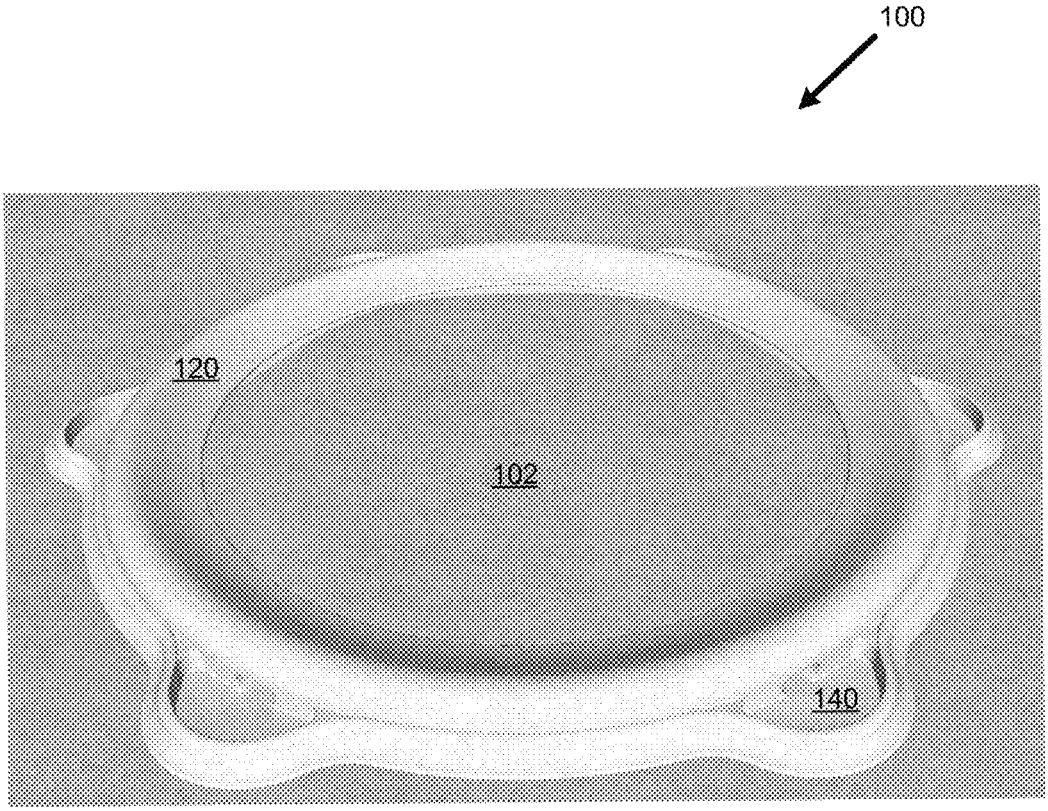
Figure 16:
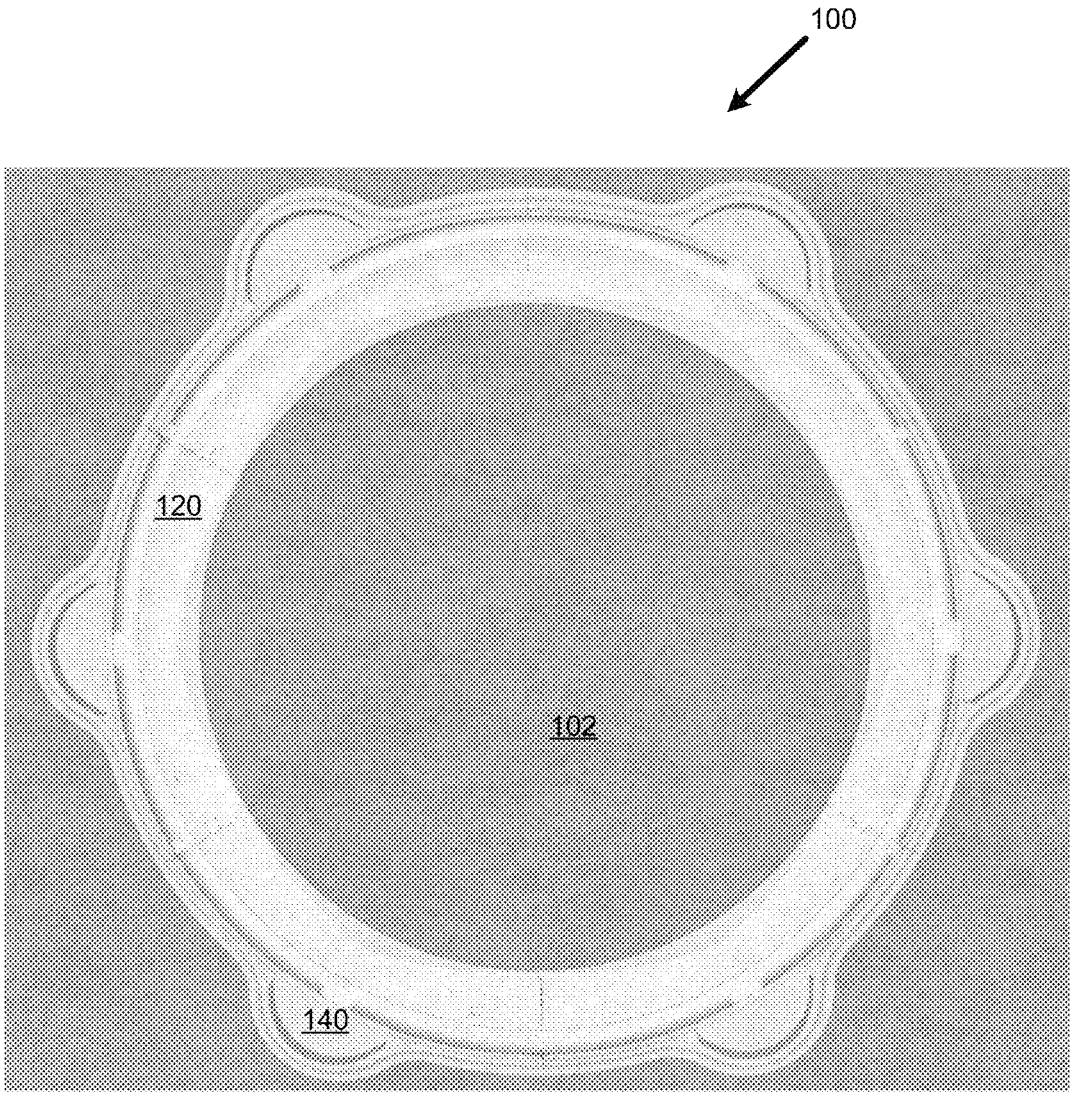
FIG. 16 shows a top view of the playing ring of FIG. 13.

FIGS. 9 and 10 show a cutaway view of the construction of a portion of the outer perimeter of the playing table. The playing board comprises a base board 14 underlying and affixed to the upper playing surface 12. The base board is stepped near its outer perimeter at a depth to accommodate the upper playing surface, which fits within. The base board is sloped 16 slightly downward and outward from this step in order to facilitate the movement of marbles off the playing surface as they pass under the top ring. The slope of the base board can vary along the perimeter to accommodate the slop of the marble guide tracks 40.

Marbles drop into marble guide tracks 40 positioned around the perimeter of the base board 14. The guide tracks slope from a high point midway between adjacent collection slot mechanisms to a low point above the collection slot mechanism 50. This facilitates movement of marbles to the collection slot mechanisms 50.

The marble 4 rolls down the marble guide track 40 and at the low point drops onto a marble channel board 52 with a channel 54 sloping down towards the outside of the table. The marble rolls down the channel 54 until it reaches a hole 56 in the end of the channel which has a vertical backing 58, whereupon the marble drops into a receiving box or holder 60. The holder 60 comprises a T-shaped set of channels 62, 64 with the top 64 of the T-shape on the outside of the table. The marble proceeds to the end of one of the channels at the top of the T-shape 64 and comes to a rest.

This marble collection mechanism prevents marbles from getting stuck inside or failing to exit the collection mechanism, and the position on the outside of the table allows marbles to be quickly and easily retrieved without being lost.

In yet another embodiment, as seen in FIGS. 13-18, the apparatus comprises a playing ring 100, which may be assembled from components or be of unitary construction (e.g., injection molded). The playing ring 100 comprises a base 110 with a top 120, which are connected along their outermost edges (the connection may be direct or through a sidewall), and surrounds a playing area 102. The playing area may be open (e.g., the playing ring is placed upon the ground, sand, a pool table, table, or other playing surface). Alternatively, the playing area may comprise a flat playing surface (similar to that described above), that is attached to or extends from the base of the ring across the center of the ring. The ring can be a circle or other polygonal shape (similar to that described above).

The top 120 extends over the base 110 to form a circumferential gap 112 through which a marble may be struck. The size of the gap may be set so as to allow only certain marbles (i.e., of smaller diameter) to pass, and to keep other marbles (with a larger diameter) on the playing surface. Marbles pass through the gap and into one of a plurality of marble guide tracks 130 positioned along the circumference of the ring (and which may be inside or outside the ring). The marble guide tracks slope from a high point downward to a plurality of marble collection trays or holders 140. The marble collection trays or holders may be located along the outermost edge of the ring, and are easily accessible for marble removal. When the marble guide tracks are located inside the ring, the marble guide tracks slope downward to a plurality of exit holes 142, which lead to the marble collection trays.

Figure 17:
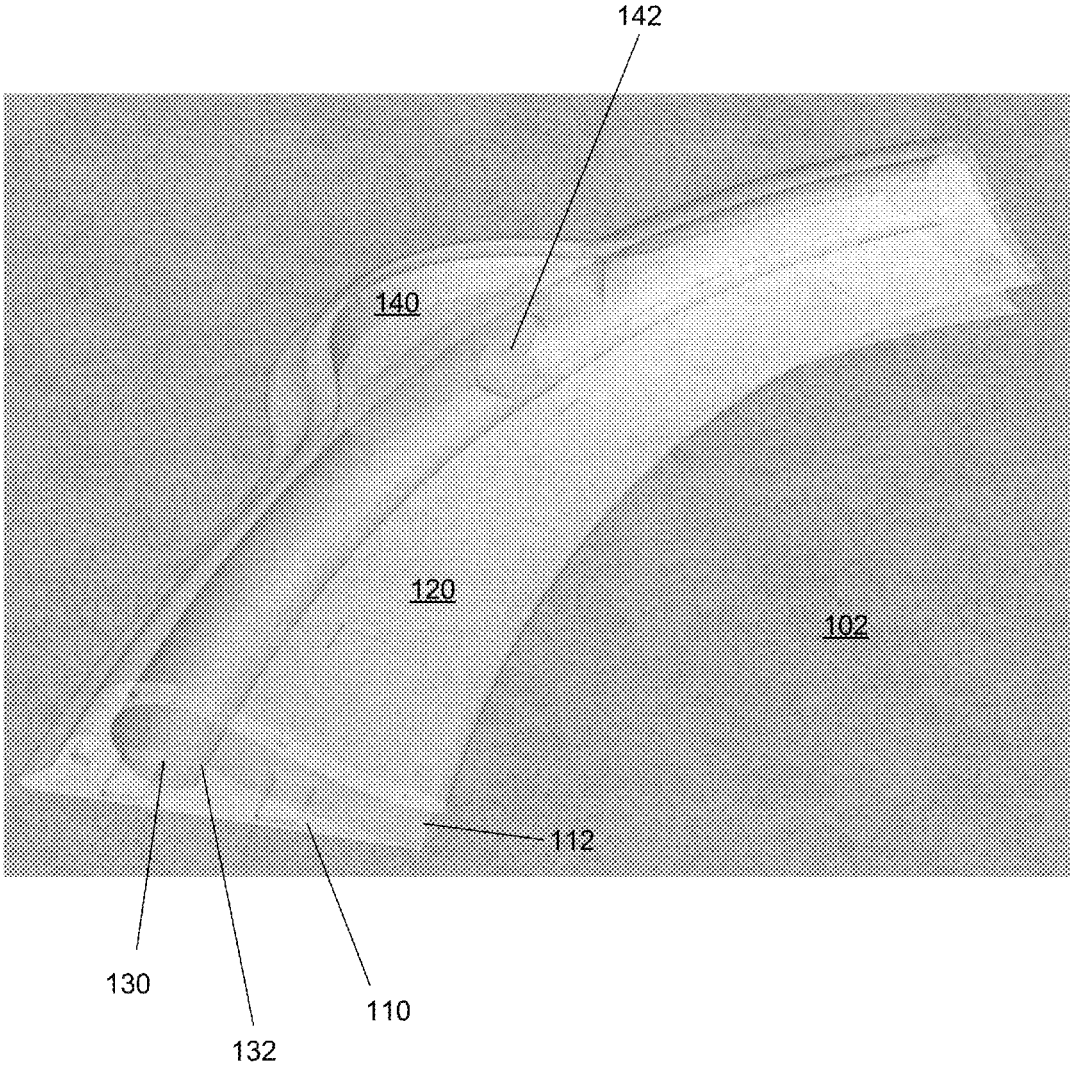
FIGS. 17-18 show cutaway views of a section of the playing ring of FIG. 13.
Figure 18:
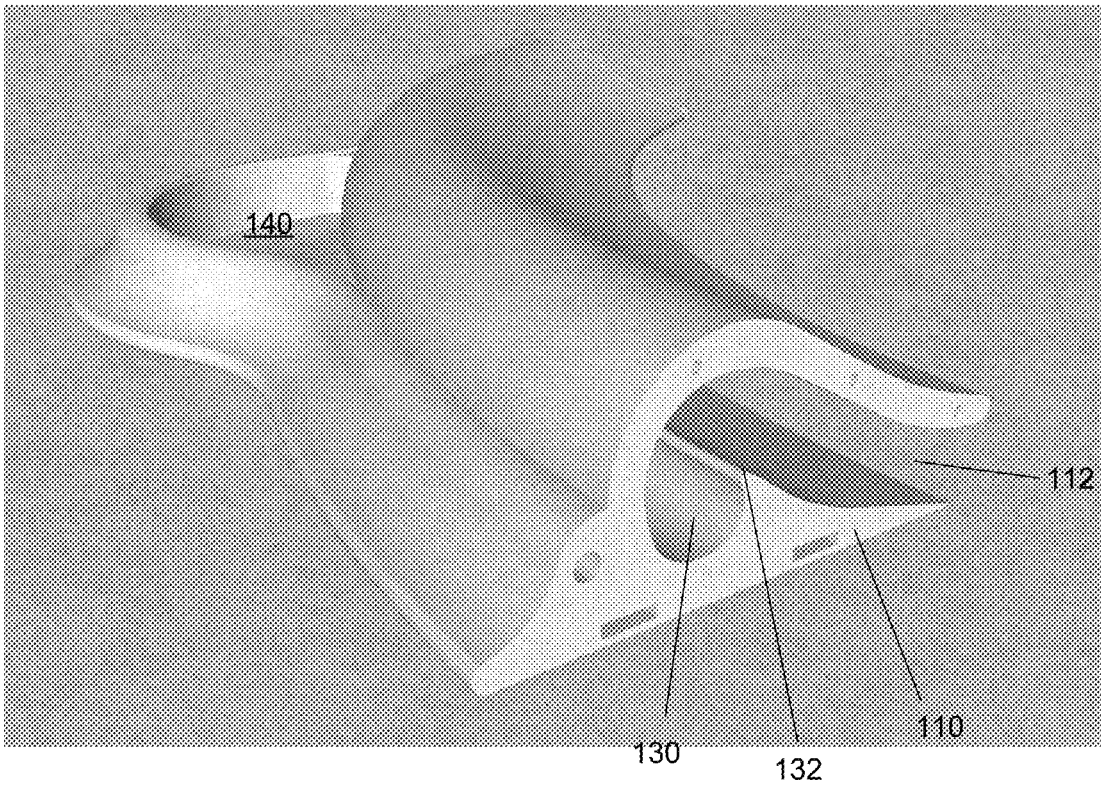

As seen in FIGS. 17 and 18, in one embodiment, the base 110 has an upper surface that slopes upward from the innermost edge to a point where it connects with the marble guide tracks. A lip 132 at the point of connection prevents the marble from exiting the guide track. A marble struck with sufficient force travels up this slope and enters the marble guide track, is prevented from exiting the marble guide track back into the playing area, and can only exit by rolling down the sloped guide track to a collection tray or holder. In the embodiment shown, a portion of the upper surface of the top 120 also slopes downward, so that marbles landing thereon roll back into the playing area.

The various embodiments described above may be fashioned of any suitable material, including, but not limited to, plastic, wood, metal, composite, cardboard, paper, or combinations thereof. The material may be opaque, translucent, or transparent, or combinations thereof, and may be colored or decorated as desired.

The above embodiments of the present invention may be used for a variety of marbles games. In one embodiment, the rules for a marbles game comprises the following:

Goal: Two to four players or teams of two compete to score the most points after all the marbles have been eliminated from the ring.

Marble Points:

Taws or shooters: 4

Moons: 18, worth 1 point each. Nine moon marbles must be shot from the ring before planets or the star can be collected for points.

Planets: 6, worth 3 points each. Planets are to be avoided until 9 moons have been shot from the ring. If a planet marble is shot from the ring before 9 moons are eliminated, then that player returns any marbles collected on that turn to the center of the ring. Once the planets have been opened they remain open.

Star: 1, worth 5 points. The star marble is the last marble to be eliminated from the ring. If a player shoots the star out of the ring before all moons and planets have been eliminated, then that player returns all their marbles to the center of the ring.

Play Rules:

Set Up: Ring 3 to 10 foot diameter with a dot in the center. Marbles are grouped in the center of the ring in a diamond pattern. Players lag to determine who will shoot first.

Shooting: Players may shoot any way they please as long as one knuckle is down on the playing surface.

Break: Player shoots the taw towards one of the long points of the diamond. Once contact is made with the target marbles, players may shoot from anywhere outside the ring.

During Play: Player's turn continues as long as the taw remains in the ring after shooting a marble out. Any player's taw is also a target for other players.

Example: If player 1 shoots player 2's taw out of the ring and player 1's taw remains in the ring, player 2 must give player 1 a marble if possible. If player 1 shoots player 2's taw out of the ring and player 1 scratches, then player 2 has the option to (a) to spot their taw in the center, or (b) choose for player 1 to place their taw in the center.

Scratch Rule: A scratch is when a player shoots their taw out of the ring. If a player scratches, all marbles collected on that shot are returned to the center.

Planet Scratch Rule: If a player scratches once the planets are open and no other marbles are shot from the ring, player forfeits 1 planet to the center of the ring if possible.

Star Scratch Rule: When the star marble is the last marble in play and a player scratches they must forfeit 1 planet, if possible, or 1 moon. If the star marble is shot from the ring and a player scratches, only the star is returned to the center. The Planet Scratch Rule stays in effect for the point leader.

Combination: If player 1 uses player 2's taw in a combination shot that eliminates the star marble and player 1's taw remains inside the ring, then player 2 or any other player's taw used in this combination must forfeit their marbles to player 1. Star marble is returned to the center and play resumes.

Beginner Level: Scratch rules do not apply. Players keep all the marbles shot out of the ring with the exception of the star. A player's taw must remain on the play area to collect.

While the above game can be played with either embodiment of the present invention, the game also can be played with other variations of marble game devices or playing services, including a simple ring drawn on the ground.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A table for playing marbles games, comprising:

a polygonal horizontal playing board supported above a base by one or more sidewalls, and providing an upper playing surface;

a polygonal horizontal top ring supported concentrically above the playing board to create a circumferential gap between the top ring and the upper playing surface, said circumferential gap adapted to allow a marble to pass through;

a plurality of marble guide tracks positioned along the perimeter of the playing board, said marble guide tracks sloping downwards from a high point at a first end to a low point at a second end; and a plurality of marble collection mechanisms positioned beneath one or more of said seconds ends, each said marble collection mechanism comprising a T-shaped channel with a portion of said T-shaped channel extending outside the sidewall.

2. The table of claim 1, wherein the top ring is padded.

3. The table of claim 1, each said marble collection mechanism comprising a marble channel board with a channel sloping downward to a hole with vertical backing, said hole positioned to drop a marble into the T-shaped channel.

4. The table of claim 3, wherein the T-shaped channel comprises a stem and top, wherein the top extends outside the sidewall, and the stem extends from inside the sidewall to outside the sidewall.

5. The table of claim 4, wherein the T-shaped channel slopes downward from the step to the top, with the lowest points being at the ends of the top.

6. The table of claim 1, further comprising one or more angled deflection strips positioned above the plurality of marble guide tracks.

7. The table of claim 1, wherein the table is adapted to be placed on a level surface.

8. The table of claim 7, wherein the level surface is a table top or counter top.

9. The table of claim 1, wherein the base is supported by three or more legs or supports.

* * * * *